US006641450B2

(12) United States Patent
Moon et al.

(10) Patent No.: US 6,641,450 B2
(45) Date of Patent: Nov. 4, 2003

(54) METHOD OF MAKING A CATHODE FOR AN ELECTRON TUBE

(75) Inventors: Sung-hwan Moon, Suwon (KR); Dong-hee Han, Suwon (KR); Seung-kwon Han, Suwon (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 178 days.

(21) Appl. No.: 09/842,786

(22) Filed: Apr. 27, 2001

(65) Prior Publication Data

US 2001/0024081 A1 Sep. 27, 2001

Related U.S. Application Data

(63) Continuation-in-part of application No. 09/705,789, filed on Nov. 6, 2000, now abandoned.

(30) Foreign Application Priority Data

Nov. 5, 1999 (KR) ..... 99-48887

(51) Int. Cl.[7] ..... H01J 9/02

(52) U.S. Cl. ..... 445/51; 445/50; 313/346 R; 313/346 DC

(58) Field of Search ..... 445/24, 25, 50, 445/51, 59; 313/346 R, 346 DC, 356; 148/280

(56) References Cited

U.S. PATENT DOCUMENTS

| | | | | |
|---|---|---|---|---|
| 3,215,557 A | * | 11/1965 | Kern et al. | 445/24 |
| 3,535,757 A | * | 10/1970 | Nesteroth et al. | 445/24 |
| 3,922,179 A | * | 11/1975 | Weekers | 445/51 |

FOREIGN PATENT DOCUMENTS

| | | |
|---|---|---|
| JP | 64-77818 | 3/1989 |
| JP | 9-97561 | 1/1997 |

* cited by examiner

*Primary Examiner*—Kenneth J. Ramsey
*Assistant Examiner*—Joseph Williams
(74) *Attorney, Agent, or Firm*—Leydig, Voit & Mayer, Ltd.

(57) ABSTRACT

A cathode for an electron tube and a preparing method therefor are provided. In the cathode for an electron tube having a base metal and an electron-emitting material layer, the particle size of the micro structure of the surface of the base metal is controlled to be in the range of 3 to 50 $\mu$m. The cathode for an electron tube has an excellent effect of diffusing intermediate products generated during the operation of the cathode, and is capable of consistently supplying a diffusion path of a reducing agent. Also, the cut off drift rate can be reduced, thereby attaining a long life span characteristic.

8 Claims, 3 Drawing Sheets

METHOD OF MAKING A CATHODE FOR AN ELECTRON TUBE

This application is a continuation-in-part of U.S. patent application Ser. No. 09/705,789, filed Nov. 6, 2000, now abandoned.

BACKGROUND OF THE INVENTION

1. Field of the Invention

The present invention relates to a cathode for an electron tube and a preparing method therefor, and more particularly, to a cathode for an electron tube having enhanced life span and electron emission characteristics and a preparing method therefor.

2. Description of the Related Art

In general, an oxide cathode is widely used as a cathode for an electron tube, the oxide cathode having an emitter made of an oxide converted from an alkaline earth metal carbonate salt having barium (Ba) as a main component, on a base metal containing nickel (Ni) as a main component and a small amount of silicon (Si) or magnesium (Mg) as a reducing agent.

Thus, the life span characteristic of an oxide cathode is largely affected by a base metal and an oxide. In particular, an intermediate product generated during the operation of an oxide cathode prevents inhibits diffusion of a reducing agent and thus greatly limits the life span of the cathode, which will now be described in detail.

FIG. 1 is an optical microphotograph of the surface structure of a conventional base metal, that is, nickel having 0.05 wt % of Si and 0.05 wt % of Mg, in which the particle size in the surface structure is approximately 100 $\mu$m. The oxide cathode is fabricated as follows. First, carbonate salt powder having barium carbonate as a main component is mixed with an organic solvent prepared by dissolving nitrocellulose and the mixture is deposited on a base metal by a spraying or electrolytically depositing method to then be mounted on an electron gun for being assembled in an electron tube. The carbonate salt is heated to approximately 1000° C. by a heater during an exhaustion step for making the inside of the electron tube into a vacuum state, during which barium carbonate is converted into barium oxide.

$$BaCO_3 \rightarrow BaO + CO_2 \quad (1)$$

During cathode operation, the thus generated barium oxide reacts with a reducing agent, Si or Mg, contained in the base metal at the interface where the base metal contacts an electron-emitting material layer.

$$BaO + Mg \rightarrow MgO + Ba \quad (2)$$

$$4BaO + Si \rightarrow Ba_2SiO_4 + 2Ba \quad (3)$$

The formed free Ba contributes to electron emission. As expressed in the formulas (2) and (3), MgO, $Ba_2SiO_4$ or the like is also formed in the interface between the electron-emitting material layer and the base metal or in the particle boundary of the base metal. The reaction product serves as a barrier called an intermediate product to thus prevent diffusion of Mg or Si, thereby making it difficult to generate free Ba which contributes to electron emission. Also, the intermediate product undesirably results in shortening of the life span of the oxide cathode. Further, the intermediate product has high resistance and prevents the flow of current for emitting electrons and thus limits current density.

To overcome these problems, a cathode prepared by depositing a metal layer made of tungsten (W), molybdenum (Mo) and the like on a base metal has been proposed in Japanese Laid-open Patent Publication No. Hei 3-257735 by Matsushita Electric Industrial Co., Ltd. However, the proposed cathode generates additional intermediate product $Ba_3WO_3$ as well as a reducing agent. Thus, initial electron emission is excessive and the electron emission and life span characteristics of the cathode decreases over time.

SUMMARY OF THE INVENTION

To solve the above problems, it is an object of the present invention to provide a cathode for an electron tube, which can solve problems of shortened life span, increased cut off drift characteristics and so on, caused by intermediate products generated in the interface between a base metal and an electron-emitting material layer during the operation of the cathode and in the particle boundary of the base metal, and a preparing method therefor.

Accordingly, to achieve the above object, there is provided a cathode for an electron tube having a base metal and an electron-emitting material layer, wherein the particle size of the micro structure of the surface of the base metal is controlled to be in the range of 3 to 50 $\mu$m.

Preferably, the particle size of the micro structure of the surface of the base metal is controlled by thermal treatment.

The thermal treatment is performed by the steps of:

(a) an oxidative thermal treatment step of heating a base metal at a temperature of 300 to 1100° C. under the atmosphere to form a metal oxide layer;

(b) a dry reducing thermal treatment step of heating the base metal having the metal oxide layer at a temperature of 500 to 1200° C. under a hydrogen atmosphere in which a dew point is kept at −50 to −90° C., to remove the metal oxide layer; and (c) a wet reducing thermal treatment step of heating the base metal treated with the step (b) at a temperature of 500 to 1200° C. under a hydrogen atmosphere in which a dew point is kept at −10 to −40° C.

The oxidative thermal treatment step is maintained at the uppermost temperature for 3 to 60 minutes.

Also, the dry reducing thermal treatment step is maintained at the uppermost temperature for 3 to 60 minutes.

Further, the wet reducing thermal treatment step is maintained at the uppermost temperature for 3 to 60 minutes.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

In order to prevent deterioration of various characteristics such as life span due to intermediate products formed during the operation of a cathode for an electron tube, it is necessary to suppress generation of the intermediate products or to consistently supply a reducing agent to an electron emitting layer by diffusing the formed intermediate product. The present invention is directed to the latter method, that is, the diffusion path of a reducing agent is consistently supplied by diffusing intermediate products by controlling a base metal to have the surface of a micro structure by thermal treatment, for achieving the effects of increasing the life span of a cathode and reducing the cut off drift rate thereof.

Figure 1:
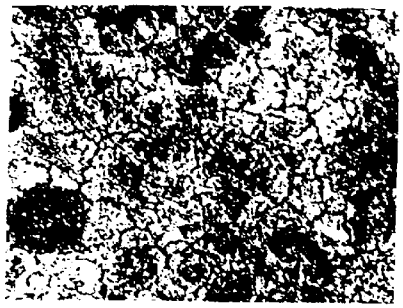
FIG. 1 (PRIOR ART)
FIG. 1 is an enlarged optical microphotograph (×200) illustrating the surface structure of a conventional base metal.
Figure 2:
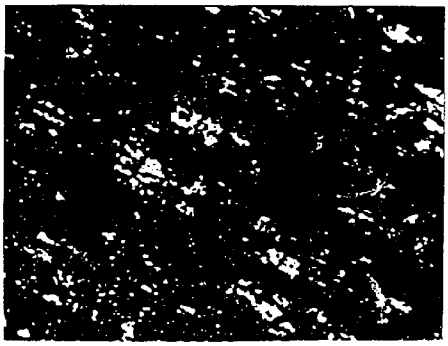
FIG. 2 is an enlarged optical microphotograph (×500) illustrating the surface structure of a base metal according to the present invention after oxidative thermal treatment.

First, in the oxidative thermal treatment step of a base metal, the base metal is heated at a temperature of 300 to 1100° C. under the atmosphere for 3 to 60 minutes. Here, nickel (Ni) which is a main component of the base metal is bonded with oxygen to form nickel oxide (NiO). The thus formed oxide layer includes a large amount of energy and the oxide layer grows very fast, thereby suppressing the growth of particles of the base metal. FIG. 2 is an enlarged optical microphotograph (×500) illustrating the surface structure of a base metal according to the present invention after oxidative thermal treatment in which the same base metal (Ni metal having 0.05 wt % of Si and 0.05 wt % of Mg) as in FIG. 1 is heated at a temperature of 800° C. under the atmosphere for 30 minutes.

Here, "particles" mean grains, and Ni atoms in a metal sample gather in groups each having the same atomic orientation to form a grain. A grain boundary means a boundary between grains. In FIGS. 1 through 5, round-looking black lines are grain boundaries.

Figure 3:
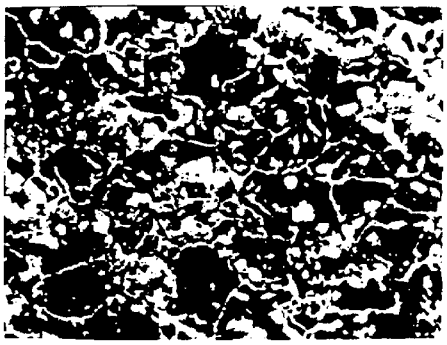
FIG. 3 is an enlarged optical microphotograph (×1000) illustrating the surface structure of a base metal according to the present invention after dry reducing thermal treatment.

Second, in the dry reducing thermal treatment step, the base metal is heated at a temperature of 500 to 1200° C. for 3 to 60 minutes under a hydrogen atmosphere in which a dew point is kept at −50 to −90° C., and the oxide layer formed in the oxidative thermal treatment step is removed. FIG. 3 is an enlarged optical microphotograph (×1000) illustrating the surface structure of a base metal according to the present invention after dry reducing thermal treatment at a temperature of 1000° C. for 8 minutes.

Finally, in the wet reduction thermal treatment step, the base metal is heated to a temperature of 500 to 1200° C. for 3 to 60 minutes in a hydrogen ambient in which a dew point is kept at −10 to −40° C., so that the concentration gradation of a reducing agent contained in the base metal can be appropriately adjusted and precipitates are formed at the particle, i.e., grain, boundary, to prevent the growth of particles.

As described above, grains are formed due to orientation of Ni atoms, and the size of a grain is related to extraction by a reducing agent. If a reducing agent of Mg or Si produces extracted oxide at the grain boundary due to wet thermal treatment or oxidative thermal treatment, grain growth can be suppressed as the amount of the produced extracted oxide increases.

Figure 4:
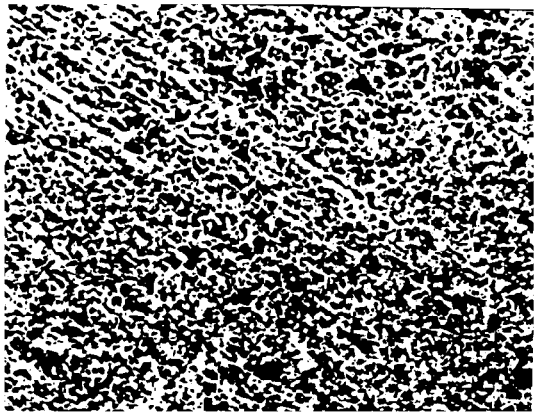
FIGS. 4 and 5 are enlarged optical microphotographs (×200 and ×500) illustrating the surface structure of a base metal according to the present invention after wet reducing thermal treatment.
Figure 5:
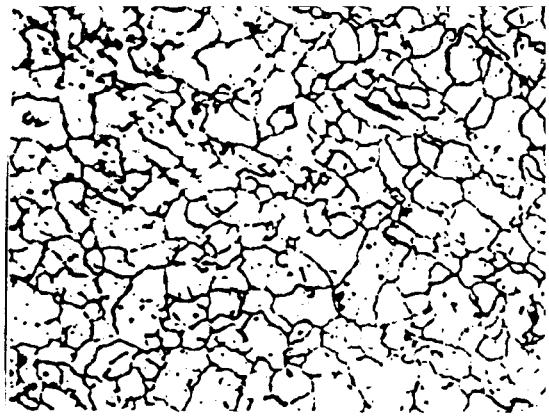

FIGS. 4 and 5 are enlarged optical microphotographs (×200 and ×500) illustrating the surface structure of a base metal according to the present invention after wet reducing thermal treatment at a temperature of 1000° C. for 8 minutes, from which it is understood that a micro structure is formed, as compared with FIG. 1 and the actual particle size ranges from 3 to 50 $\mu$m.

In the respective thermal treatment steps, the heating temperature is an appropriate temperature for inducing sufficient oxidation and reduction of the base metal, and the heating time is an appropriate time for controlling the base metal to have the surface of a micro structure.

In other words, according to the present invention, the particle size of the micro structure of the surface of the base metal can be controlled to be in the range of 3 to 50 $\mu$m, so that the intermediate products generated during the operation of the cathode are diffused and the diffusion path of a reducing agent is consistently supplied, thereby increasing the life span of the cathode and reducing the cut off drift rate thereof.

Throughout the specification, it has been described that Ni metal containing 0.05 wt % of Si and 0.05 wt % of Mg, is used as a base metal with reference to a preferred embodiment of the present invention, but the invention is not limited thereto. The content and kind of the reducing agent can vary as necessary.

Any electron-emitting material that is used in the art can be used as the electron-emitting material used for a cathode for an electron tube according to the present invention. Detail examples of the electron-emitting material include oxide converted from alkali earth metal carbonate salt layer containing barium as a main component, preferably, a three-element carbonate salt consisting of (Ba, Sr, Ca)$CO_3$ or a two-element carbonate salt consisting of (Ba, Sr)$CO_3$. Further, in order to improve electron emission and life span characteristics, scandium oxide, barium-scandate or lanthanum-magnesium composite oxide may be added to the three-element carbonate salt consisting of (Ba, Sr, Ca)$CO_3$ or the two-element carbonate salt consisting of (Ba, Sr)$CO_3$. Also, tungsten or molybdenum may be coated on the surface of the electron-emitting material layer.

The performances and effects of a cathode for an electron tube according to the present invention will now be described. The cathode for an electron tube according to the present invention is manufactured in the following manner.

The surface of the Ni metal containing 0.05 wt % of Si and 0.05 wt % of Mg, as described above with reference to FIGS. 1 and 4, is cleaned and then nitrocellulose-series suspension having 0.07 wt % of La-Mg compound added to the three-element carbonate salt consisting of (Ba, Sr, Ca)$CO_3$, is spray-coated and dried, thereby fabricating a carbonate salt cathode. The fabricated cathode is inserted into an electron gun to be fixed, and then a heater for heating the cathode is fixedly inserted into a sleeve. The electron gun is sealed to a bulb for an electron tube and is then subjected to an exhaustion step, thereby completing an oxide cathode.

The life span characteristics of the aforementioned cathode employing the base metal shown in FIG. 1 (Comparative Example) and the cathode employing the base metal shown in FIG. 4 (Example) were evaluated.

Figure 6:
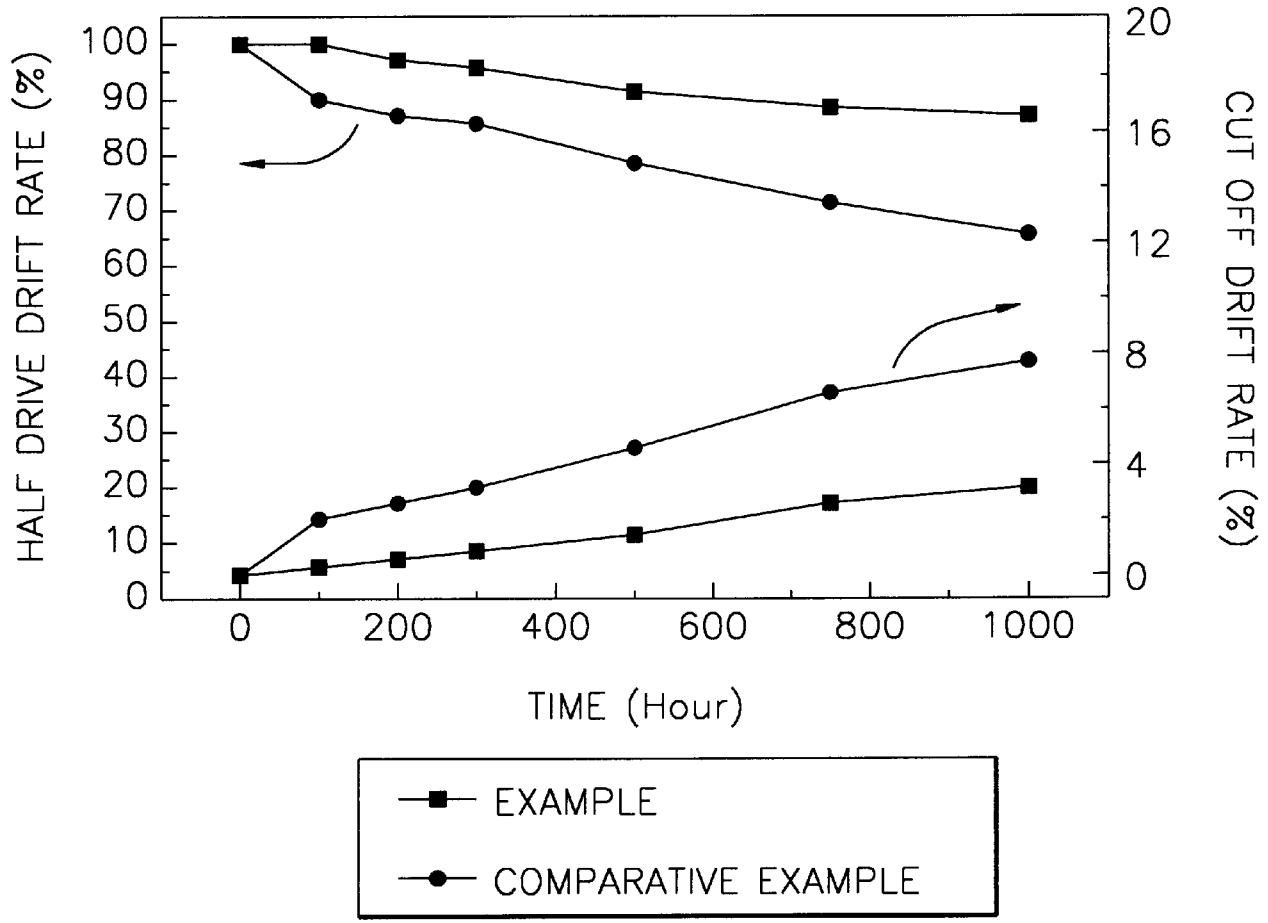
FIG. 6 is a graph showing the measurement result of half drift rate and cut off drift rate of cathodes for an electron tube according to Example and Comparative Example.

FIG. 6 shows the result the accelerated life test (6.9 V, 3 A/cm$^2$) for each three sets of 15" electron tubes using the cathodes prepared by Comparative Example and Example of the present invention. Referring to FIG. 6, it is understood that the cathode prepared by Example of the present invention is excellent in view of both an electron emitting characteristic (that is, a half drift rate) and a cut off drift rate. The reducing effect of the cut off drift rate is 20% or more. Generally, the life span of a cathode is defined by an MTTF (Mean Time to Failure Mode), that is, the time lapsed until the 1K residual rate becomes 50%. The life span of the cathode according to the present invention is 20,000 to 30,000 time, 25% or higher than that of the conventional oxide cathode being 10,000 to 15,000 hours, thereby noticeably enhancing the life span characteristic even at high current density due to the recent tendency of high precision and large screen television Braun tubes.

As described above, according to the present invention, the micro structure of the surface of a base metal and the concentration gradation of a reducing agent contained in the base metal can be freely controlled by a series of thermal treatment steps, that is, an oxidative thermal treatment step, a dry reducing thermal treatment step and a wet reducing thermal treatment step. Therefore, the cathode for an electron tube according to the present invention has an excellent effect of diffusing intermediate products generated during the operation of the cathode, and is capable of consistently supplying a diffusion path of a reducing agent. Also, the cut off drift rate can be reduced, thereby attaining a long life span characteristic.

What is claimed is:

1. a method of preparing a cathode for an electron tube, comprising:

oxidizing a base metal by heating to a temperature of 300 to 1100° C. in an oxidating oxidizing atmosphere to form a metal oxide layer; dry reducing the base metal having the metal oxide by heating to a temperature of 500 to 1200° C. in a hydrogen atmosphere having a dew point kept at −50 to −90° C., to remove the metal oxide layer; and wet reducing the base metal by heating to a temperature of 500 to 1200° C. in a hydrogen atmosphere having a dew point kept at −10 to 40° C.

2. The method according to claim 1, wherein in oxidizing, maintaining an uppermost temperature for 3 to 60 minutes.

3. The method according to claim 1, wherein in dry reducing, maintaining an uppermost temperature for 3 to 60 minutes.

4. The method according to claim 1, wherein in wet reducing, maintaining an uppermost temperature for 3 to 60 minutes.

5. The method according to claim 1 including, after the wet reducing treatment, forming an electron-emitting material on the base metal.

6. The method according to claim 5 including spraying a solution including barium carbonate on the base metal as the electron-emitting material.

7. The method according to claim 1 including controlling micro structure of the base metal in forming the metal oxide layer, removing the metal oxide layer, and wet reducing to have a particle size of 3 to 50 $\mu$m.

8. The method according to claim 1 wherein nickel is a main component of the base metal.

* * * * *